United States Patent [19]

Sterner, Jr.

[11] 4,320,597

[45] Mar. 23, 1982

[54] WINDOW LATCH

[75] Inventor: Maurice E. Sterner, Jr., York, Pa.

[73] Assignee: Schlegel Corporation, Rochester, N.Y.

[21] Appl. No.: 121,581

[22] Filed: Feb. 14, 1980

Related U.S. Application Data

[63] Continuation-in-part of Ser. No. 109,408, Jan. 3, 1980.

[51] Int. Cl.[3] ..... E05C 1/10

[52] U.S. Cl. ..... 49/449; 49/454

[58] Field of Search ..... 49/449, 450, 453–459, 49/183, 176, 194; 160/89, 90, 91; 292/DIG. 44; 70/143

[56] References Cited

U.S. PATENT DOCUMENTS

| | | | |
|---|---|---|---|
| 1,286,344 | 12/1918 | Kenneweg | 70/143 |
| 3,345,778 | 10/1967 | Brand | 49/450 |
| 3,959,926 | 6/1976 | Noecker et al. | 49/450 X |
| 4,079,479 | 3/1978 | Clement | 49/449 X |

*Primary Examiner*—Philip C. Kannan

*Attorney, Agent, or Firm*—Cushman, Darby & Cushman

[57] ABSTRACT

This invention relates to a window latch, especially a latch for holding a slidable storm window sash in a perimeter frame assembly.

3 Claims, 4 Drawing Figures

WINDOW LATCH

BACKGROUND

This application is a continuation-in-part of application Ser. No. 109,408 filed Jan. 3, 1980.

The introductory part of that application discloses that a common form of storm window in present day use includes a sash which is vertically slidable in a perimeter frame for the purpose of opening the window, the frame being mounted to the exterior of the building in overlying relationship to a prime window. In one well-known type of construction the sash is a removable tilt-type sash, by which is meant that the sash can be removed from the frame for cleaning by a manual tilting operation. Specifically, each of the vertical side rails of the sash is provided near its upper end with a laterally projecting pin which rides in a vertical channel formed by the side members of the perimeter frame. The lower portion of the sash is releasably latched to the side members of the frame by means of manually operable slide bolts or the like. Upon retraction of the slide bolts the sash can be manually tilted about the axes of the pins; that is, the lower edge of the sash can be swung inwardly into the building and upwardly toward the operator. When the lower edge of the sash has been elevated a substantial distance it is a simple matter to remove the sash from the frame by lowering one side rail of the sash relative to the other so that the pins no longer reside in the channels in the frame.

It is inherent in the type of window construction summarized above that the perimeter frame does not include a fixed channel which receives the vertical side rails of the storm sash when in its closed position, as is typical for a slidable sash in a prime window. That is, if the storm sash is to be removed by tilting, the conventional frame cannot form a fixed vertical flange or web which overlies those surfaces of the sash side rails which face inwardly toward the interior of the building. The result is that there is considerable leakage of air past the sash even though weather stripping is usually provided between the laterally facing surfaces of the side rails and the frame and between the outwardly facing surfaces of the side rails and the frame. Thus there is no weather stripping along the inner faces of the sash side rails, and in addition the lack of support for these faces may permit the sash to bow slightly inwardly toward the interior of the building under the influence of wind, thereby decreasing the effectiveness of the existing weather stripping.

The window described in application Ser. No. 109,408 overcomes the above-summarized disadvantages by means of special vertically movable sash retainers which provide support and sealing for a movable sash when in its down position. The sash retainers are slidable upwardly to permit removal of the sash from the retainers and from the perimeter frame. Pivot pins for the sash are not required. More specifically, a slidable sash retainer is releasably connected to each of the two longitudinal side members of the sash so as to be movable with the sash if desired, the arrangement being such that the retainers can assume either a lower sash-retaining position or an upper non-retaining position. In their non-retaining position the sash can be removed from the perimeter frame for cleaning. In their sash-retaining position the retainers prevent bowing of the sash during windy weather. In addition, they provide a space between their outwardly facing surfaces and the inwardly facing surfaces of the sash side members, into which space can be inserted weather stripping material. As a result of these two features the leakage of air past the sash is much reduced.

The releasable connection between the sash and the slidable sash retainers comprises a pair of latch assemblies which also permit latching of the sash against vertical movement. Each latch assembly includes a latch bolt or the like which is slidable laterally into and out of a notch or hole formed in the respective frame side member at a position to latch the sash in its closed position. Each retainer has a hole therethrough to permit the latch bolt to pass through the retainer into the notch. In their fully retracted positions the latch bolts do not reside in either the notches or the holes in the retainers. When it is desired to raise the sash retainers the latch bolts are slid to an intermediate position in which they reside in the holes in the retainers but not in the notches in the perimeter frame. The present invention is concerned with providing a latch assembly which can easily be adjusted to the correct intermediate position.

SUMMARY OF THE INVENTION

In accordance with the present invention a horizontally slidable window sash latch of the type described above has associated therewith a manually adjustable selector member which is capable of selectively holding the latch in an intermediate position such that the latch engages the sash retainer but does not prevent the sash from being raised or lowered. The selector member includes a projection which, upon adjustment of the member, moves into a recess in the horizontal sash member to restrict sliding movement of the latch. When the projection is moved out of the recess the latch is free to move between its fully extended position or its fully retracted position.

In the preferred embodiment the selector member is carried in a recess in the latch and is rotatable about an axis transverse to the plane of the sash. The arrangement of the projection is such that it moves in a plane parallel to the plane of the sash. In its retainer-engaging position the projection extends above or below the latch and into a recess in the sash member on which the latch is mounted. When the selector member is rotated 90° the projection moves out of the recess into the channel in which latch is mounted.

DETAILED DESCRIPTION

Figure 1:
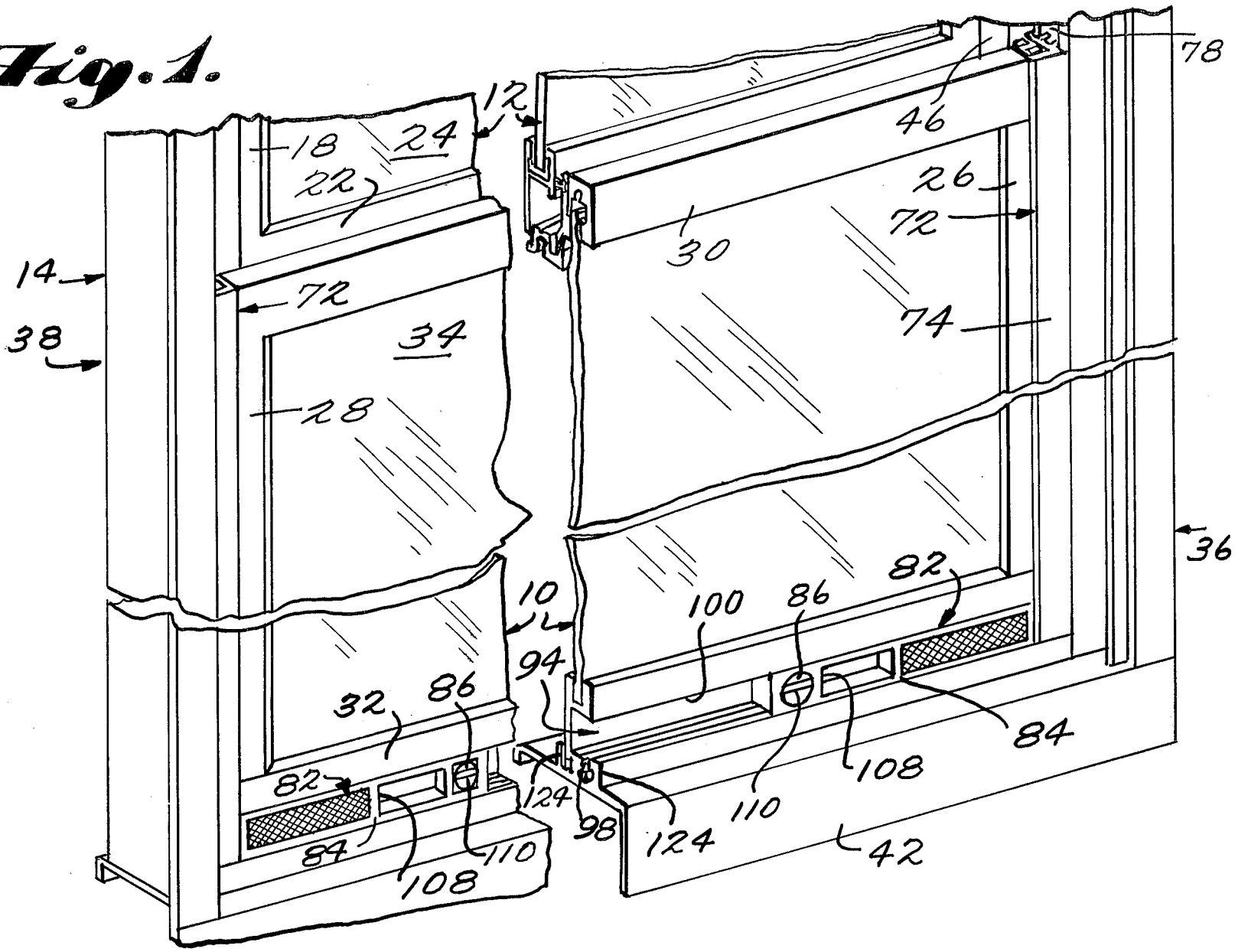
FIG. 1 is a perspective view of the lower sash of a storm window embodying the latch arrangement of the present invention.

The window illustrated in the drawings is a double-hung storm window adapted to be secured to the exterior of a building in overlying relationship to a prime window. The basic components of the window are a lower sash 10 and an upper sash 12, both mounted in a perimeter frame 14 for vertical sliding movement. The upper sash 12 includes two-spaced apart parallel longitudinal or vertical members 16, 18 joined to two transverse or horizontal members one of which is shown at 20 and a transparent light or pane 24. Similarly the lower sash 10 includes two longitudinal members 26, 28, two transverse members 30, 32 and a transparent pane 34. The perimeter frame 14 is constructed of longitudinal vertical side members 36, 38, a lower horizontal transverse member 42 and an upper horizontal member (not shown). The sash members and frame members, as is conventional, may be made from extruded aluminum sections. The edges of the panes 24 and 34 are fitted into their respective sash members in any convenient manner, preferably with the use of channel shaped gaskets 43 which may be of known construction.

The upper sash 12 when in its up position is retained in the perimeter frame partially by the upper frame member (not shown) and by the frame side members 36 and 38. Each of the frame side members 36 and 38 includes a channel construction, such as that illustrated by spaced-apart parallel flanges 44 and 46. The outer flange 44 extends the entire length of the frame side member 36. The vertical dimension of the inner flange 46 is no greater than the vertical dimension of the upper sash 12, in order to permit removal of the upper sash 12 from the perimeter frame 14. The upper frame member (not shown) includes two depending flanges and which form a channel for the upper transverse member not shown of the upper sash 12.

The inner and outer surfaces of the upper sash member and the inner and outer surfaces of the sash side members 16 and 18 are fitted with strips of weather stripping material, preferably of the pile type which includes a resilient fibrous pile 54 protruding from a base 56. The various sash members are formed with channels to receive and retain the weather stripping in a manner such that the pile 54 extends into contact with the various flanges.

When in its up position the upper sash 12 is prevented from moving downwardly by a pair of latch assemblies (not shown) mounted on the lower sash member 22. Each latch assembly includes a latch bolt or the like which is slidable laterally into and out of a notch or hole formed in the respective frame side member 36 or 38. Conveniently, the latch bolts are spring biased laterally outward, and the latch assembly includes thumb or finger recesses facing inwardly into the building for engagement by the thumbs or fingers of an occupant.

A screen, now shown, may be mounted in or on the perimeter frame 14, in coextensive relationship with the lower sash 10, if desired.

The mounting of the lower sash 10 is compatible with, but does not require a slidable or removable upper sash. The mounting arrangement for the lower sash 10 includes two vertically movable sash retainers 72 which provide support and sealing for the inner surface of the lower sash 10 when the latter is in its down position. The retainers 72 are preferably made of rigid synthetic plastics material such as polyvinyl chloride. Conveniently the retainers 72 have a shape which enables them to be formed by extrusion. One essential feature of the retainers is that they each include a vertical fin 74 which lies in the plane of the window and which overlies essentially the entire length of the inner surface of the adjacent side member 26 or 28 of the lower sash 10. The fin 74 in cooperation with a parallel wall portion 76 of the respective frame side member 36 or 38 forms a channel for receiving the sash side member 26 or 28. Alternatively the retainer 72 itself may include a wall portion which cooperates with the fin 74 to provide a channel for the sash side member 26 or 28.

The vertical dimensions of the retainers 72 are about equal to the vertical dimension of the lower sash 10. This permits the retainers 72 to assume a raised position such that the lower sash 10 in a down position can be removed from the perimeter frame 14. It is intended that the retainers 72 be more or less permanently attached to the perimeter frame 14 while at the same time being readily slidable in vertical directions. This can be achieved by providing vertical interlocking complementary surfaces on the retainers 72 and on the respective frame side members 36 and 38. In the illustrated assembly each side member 36 and 38 is provided with a vertical channel 78 which is box-shaped in cross-section. Each retainer 72 is provided with two legs 80, L-shaped in cross-section, which are retained in the respective channel 78 and which are vertically slidable therein. The plastic material of which the retainers 72 are made slides easily in contact with the frame side members 36 and 38.

In accordance with the invention the lower sash 10 is provided with a pair of special latch assemblies 82 which are selectively adjustable to perform three functions: (1) latching of the sash and the sash retainers against vertical movement, (2) latching of the sash to the sash retainers 72 while permitting vertical movement of the sash and (3) unlatching of the sash from both the sash retainers and the perimeter frame. Each assembly includes a slidable latch member 84 and a rotatable selector member 86 fitted into a complementary hole 88 in the latch member 84. The outer end 89 of each latch member 84 is horizontally slidable into and out of a notch 90 or hole formed in the respective frame side member 36 or 38 at a location to releasably latch the lower sash 10 in its closed position. Other notches, not shown, may be provided in the frame side members 36 and 38 at locations which permit the lower sash 10 to be releasably latched in intermediate positions. The sash retainers 72 are provided with holes 92 to permit the latch members 84 to pass through the retainers 72 into the notches 90. In their fully retracted positions the latch members 84 do no reside in the holes 92 in the retainers 72; this permits the lower sash 10 to slide independently of the retainers 72 when desired, as when removing the lower sash 10 by an operation described hereinafter.

Each latch member 84 is an elongated generally rectangular element slidably mounted in an outwardly facing channel 94 in the sash member 32. The lower surface of each member 84 has a rib 96 projecting therefrom into a complementary groove 98 in the bottom wall of the channel 94. The upper edge of the channel 94 includes a depending flange 100 which in conjunction with the rib 96 and the groove 98 retain the member 84 in the channel 94. Each latch member 84 is biased toward its respective side frame member 36 or 38 by a spring assembly which fits into a recess 101 in the member 84. Each assembly includes a compression spring 102 and a foot 104. The foot 104 fits into a hole in the bottom wall 106 of the channel 94 so as to fix one end of the spring 102. The other end of the spring 102 presses against a vertical wall of the recess 101 and thereby urges the latch member 84 laterally outwardly. A thumb or finger recess 108 is provided in the front face of each latch member 84 for engagement by the thumb or fingers of an occupant.

Figure 4:
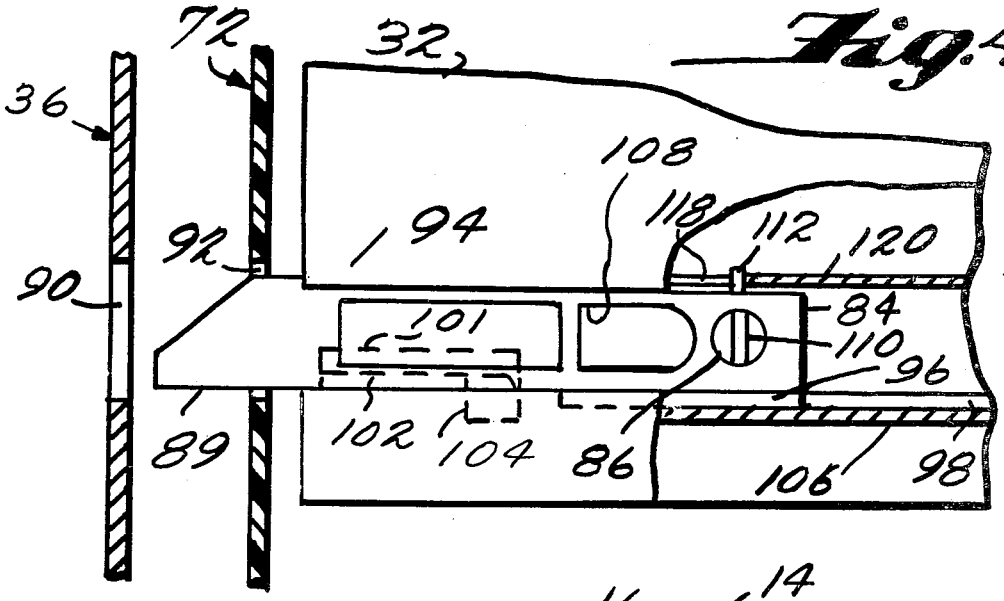
FIG. 4 is a fragmentary view, on an enlarged scale and partly broken away, showing the cooperation of the latch member with the lower sash member.
Figure 2:
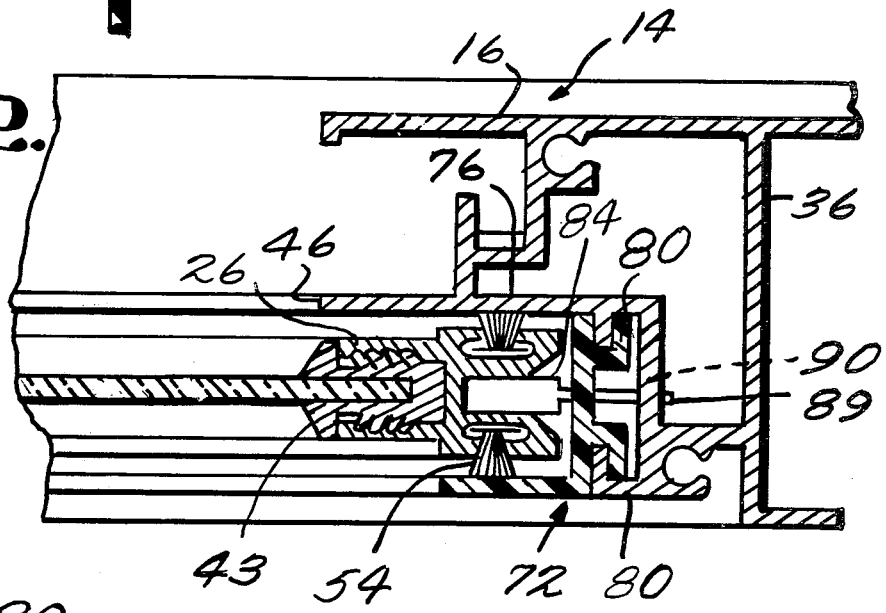
FIG. 2 is a fragmentary horizontal sectional view of the lower sash of FIG. 1.
Figure 3:
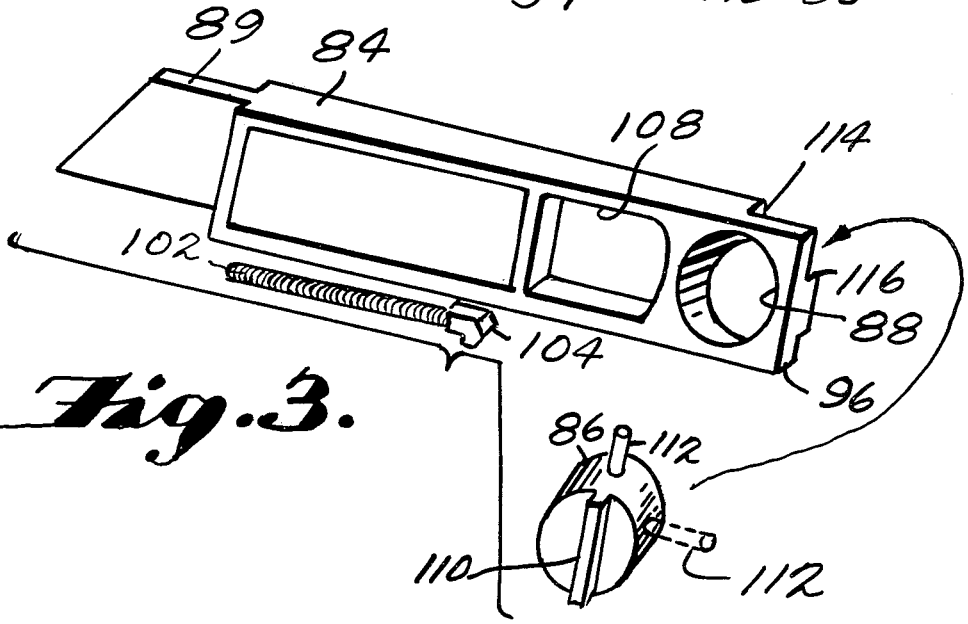
FIG. 3 is an exploded view of one of the latch members of FIG. 1.

The selector member 86 is a cylindrical element having a finger-gripping rib 110 projecting axially from its forward end and a radially extending stop pin 112. The members 84 and 86 are assembled by pushing the member 86 into the cylindrical hole 88 from the back. In this position the stop pin 112 resides in a cut-out in the back side of the member 84, the cut-out having a vertical wall 114 and a horizontal wall 116 which can be engaged by the stop pin 112 so as to limit rotation of the member 86 to 90°. When the stop pin 112 is vertical it projects above the upper edge of the latch member 84 and resides in a hole 118 in the top wall 120 of the channel 94. In this position, as seen in FIG. 4, the end 89 of the latch member 84 extends through the hole 92 in the sash retainer 72 but does not extend into the hole 90 in the frame side member 36. If the selector member 86 is rotated clockwise as viewed in FIGS. 3 and 4 the stop pin 112 moves out of the hole 118 whereupon the latch member 84 can be slid to the right by an occupant's thumb or fingers.

Weather stripping material 54 is provided on the inner and outer surfaces of the lower sash member 32, on the inner and outer surfaces of the sash side members 26 and 28. In the closed position of the lower sash 10 a seal is formed between the lower sash member 32 and two upstanding flanges 124 on the lower frame member 42. Other seals are formed between the opposed sash members 22 and 30 and between sash members 26, 28 and the wall 76. As in the case of the upper sash 12 the weather stripping 54 is of the pile type and is fitted into channels in the respective sash members. The weather stripping material 54 on the inner surface of the sash side members 26 and 28 is effective due to the presence of the fin 74 on each of the sash retainers 72. As described previously it is not conventional to include weather stripping material in this location because conventionally there is no flange overlying the inner surfaces of the lower sash side members when the lower sash is in a closed position. Thus the fin 74 serves to support the lower sash 10 against inward bowing and to provide a sealing surface to reduce infiltration of air. With respect to bowing, as might occur during windy weather, it is apparent that such bowing would permit the weather stripping material 54 on the outer surface of the sash side members 26 and 28 to move away from the wall 76 thereby reducing or destroying the seal.

The procedure for removing the lower sash 10 is as follows. It is assumed that the stop pins 112 and the gripping ribs 110 are horizontal, that the sash 10 is closed and that the latch member ends 89 reside in the holes 90 in the frame side members 36 and 38 under the action of the springs 102. The occupant of the building places thumbs or fingers in the recesses 87 of the latch assemblies 82 and retracts the latch members 84 from the holes to a position in which the stop pins 112 engage the ends of the holes 118, as shown in FIG. 4. The sash 10 and the retainers 72 are then raised to a full up position in which the retainers 72 become releasably latched by a latch (not shown) mounted on the perimeter frame. The latch members 84 are then allowed to move slightly inward and the ribs 110 are manually turned 90° to horizontal positions. Then the latch members are moved outwardly and held in this position so that the ends 89 are free of the holes 92 in the retainers, whereupon the sash 10 is lowered, leaving the retainers up. In this position, the sash side members 26 and 28 reside below and clear of the fins 74 of the sash retainers 72. The sash 10 can therefore be removed from the perimeter frame 14 by pulling it toward the interior of the building, provided that the latch members 84 remain retracted.

To remove the upper sash 12 the building occupant first places thumbs or fingers in the recesses of the latch assemblies (not shown) associated with that sash and retracts the latch members from the notches in the frame side members 36 and 38. Next the upper sash is slid vertically downwardly to a position such that it resides below the lower ends of the flanges 46. The upper sash 12 can then be moved inwardly in the manner described above with respect to the lower sash 10. The upper sash 12 is thus removable from the perimeter frame through the opening left by removal of the lower sash 10.

To replace the sashes 12 and 10 the above steps are reversed.

What is claimed is:

1. In a window assembly: at least two window sashes having inwardly facing surfaces and outwardly facing surfaces, said sashes being fitted into a perimeter frame formed by spaced apart longitudinal members joined at their ends to the ends of spaced apart transverse members, and means mounting at least one of the sashes for sliding movement in said frame in a longitudinal direction between a closed position and an open position and for inward movement relative to the frame; a sash retainer mounted on each longitudinal frame member for longitudinal sliding movement relative to the respective frame member, each retainer having a longitudinal dimension about equal to the longitudinal dimension of said slidable sash and being slidable between a first position coextensive with said slidable sash and a second position in which the retainer is longitudinally offset from said slidable sash, each retainer having a longitudinal fin overlying the inwardly facing surface of the respective longitudinal edge of said slidable sash when said sash and said retainer are coextensive to thereby provide support and sealing said surface; and manually releasable latches carried by said slidable sash for releasably connecting said slidable sash to said retainers and to said longitudinal frame members, each of said latches including a slidable latch member movable between an extended position in which ends of said members extend through holes in said sash retainers and into latching engagement with the respective longitudinal frame member and a retracted position in which said ends are clear of the holes in said sash retainers, and each of said latches including a manually adjustable selector element selectively operable to hold said latch members in an intermediate position in which said ends reside in said holes in said sash retainers and are clear of said longitudinal frame members.

2. A vertically slidable window sash having vertical edges which in use of the sash cooperate with two spaced-apart vertical members of a perimeter frame and with a slidable member disposed between each vertical sash edge and the respective vertical frame member and a latch assembly carried by said window sash near each vertical edge thereof, each latch assembly including a latch member having an outer end, said latch member being slidable between an extended position in which said outer end projects laterally beyond the respective vertical sash edge and a retracted position, and means forming part of the latch assembly for releasably retaining said latch member in an intermediate position between its extended position and its retracted position.

3. A window sash as in claim 2 wherein said means for releasably retaining said latch member in an intermediate position includes an adjustable stop element carried by said latch member, said element being manually adjustable to a position in which it is engageable with said sash to restrain movement of said latch element to its retracted position.

* * * * *